United States Patent [19]

Hayden et al.

[11] Patent Number: 4,690,470

[45] Date of Patent: Sep. 1, 1987

[54] ROTATING SHAFT ELECTRICAL CONNECTION

[75] Inventors: Howard L. Hayden, Rockford; Vallabh V. Vaghani, Belvidere; John Readman, Rockford, all of Ill.

[73] Assignee: Sundstrand Corporation, Rockford, Ill.

[21] Appl. No.: 862,318

[22] Filed: May 12, 1986

[51] Int. Cl.[4] ..... H01R 39/02

[52] U.S. Cl. ..... 439/13; 439/814

[58] Field of Search ..... 339/2 R, 5 R, 126 R, 339/263 R, 263 L, 272 A

[56] References Cited

U.S. PATENT DOCUMENTS

| | | | |
|---|---|---|---|
| 914,327 | 3/1909 | Barbour | 339/272 A X |
| 2,590,559 | 3/1952 | Miller . | |
| 2,772,046 | 11/1956 | Shomphe . | |
| 2,798,977 | 7/1957 | Henber | 339/94 A X |
| 3,023,331 | 2/1962 | Hoffman et al. | 339/263 R X |
| 3,573,516 | 4/1971 | Lyon et al. | 310/68 |
| 3,850,501 | 11/1974 | Butterfield et al. | 339/263 R |
| 4,098,546 | 7/1978 | Swartz et al. | 339/5 R |
| 4,268,769 | 5/1981 | Dorner et al. | 310/67 R |
| 4,458,228 | 7/1984 | Baumgartner | 335/229 |

*Primary Examiner*—Z. R. Bilinsky

*Attorney, Agent, or Firm*—Wood, Dalton, Phillips, Mason & Rowe

[57] ABSTRACT

To provide for electrical connection of electrical components through a rotating shaft in a manner facilitating assembly and disassembly of the connection for replacement of the components, a connector assembly is provided. The connector assembly includes an insert disposed within an insulator both of which are fixed within the rotating shaft in proximity to an opening therein, electrical terminals or contacts associated with each of the electrical components in spaced relation thereto, and a conductive bushing extending through the opening in the rotating shaft in electrically isolated relation thereto. Additionally, the connector assembly includes an externally threaded fastener for releaseably securing the electrical terminals or contacts and the conductive bushing to the insert in the insulator to electrically interconnect the electrical components in a manner accessible externally of the rotating shaft.

6 Claims, 2 Drawing Figures

ROTATING SHAFT ELECTRICAL CONNECTION

FIELD OF THE INVENTION

This invention relates to a rotating shaft electrical connection, and more specifically, to a connection for an electrical apparatus having a hollow rotating shaft.

BACKGROUND OF THE INVENTION

In many applications, it is a problem to make a secure and dependable electrical connection through a rotating shaft for components of an electrical apparatus. This is particularly true in electrical apparatus such as generators and the like where the rotating shaft may operate at variable speeds up to 30,000 R.P.M. or more and at temperatures on the order of 300° to 350° F. Under such conditions, electrical connections must be capable of withstanding high centrifugal forces and other severe environmental conditions.

In both commercial and military fields, it is also highly desirable for electrical connections to accommodate assembly and disassembly without damage to component parts. For instance, in high frequency generators for aircraft such electrical connections are needed to interconnect the exciter to the rectifier and/or the rectifier to the main field of the generator where the various component parts rotate with the shaft. In the past, lead wires were either fed directly through the shaft or joined in a brazed joint outside the shaft.

In either case, the resulting assembly was less than completely satisfactory. Where the lead wires were fed directly through the rotating shaft, the high centrifugal forces coupled with high temperature would eventually cause the shaft to cut through the insulation of the lead wires to thereby create a short circuit and/or damage to components connected thereby, and where the lead wires were joined in a brazed joint outside the shaft, it has proven to be difficult, if not impossible, to disassemble the generator in an efficient and effective manner to replace damaged component parts. Moreover, it has generally been thought that connectors such as screws were undesirable for a number of reasons.

Among the reasons for avoiding screws is their tendency to loosen when subjected to vibration and centrifugal forces. This has generally been thought to be relatively critical in view of the fact that the screws and screw threads have usually been required to carry electrical current. As a result, fasteners such as screws that may loosen and/or insulation material that may shrink are avoided in electrical connections.

While overcoming problems of this type, it is desirable to provide a secure electrical connection between component parts on a rotating shaft assembly of an apparatus such as a high frequency generator. It is also desirable to eliminate the difficulty or impossibility of replacing component parts by facilitating assembly and disassembly in the electrical connection. Further, it is desirable to provide a component part rotating shaft electrical connection that is inexpensive to manufacture and maintain.

The present invention is directed to overcoming the above stated problems and accomplishing the stated objects.

SUMMARY OF THE INVENTION

It is principal object of the present invention to provide a new and improved rotating shaft electrical connection for component parts of an electrical apparatus.

More specifically, it is an object of the invention to provide means for electrically interconnecting electrical components disposed externally and internally of a rotating shaft in a secure manner relatively independent of high centrifugal forces or other severe environmental conditions. It is likewise an object of the invention to provide an electrical connection through a rotating shaft of an apparatus such as a high frequency generator in a manner facilitating assembly and disassembly.

An exemplary embodiment of the invention achieves the foregoing objects in an electrical apparatus having a hollow rotating shaft. The electrical apparatus has an electrical component disposed externally of the rotating shaft and adapted to rotate therewith and an electrical component disposed internally of the rotating shaft and adapted to rotate therewith, and the externally disposed electrical component is adapted to be electrically interconnected to the internally disposed electrical component. In addition, means are provided for electrically interconnecting the electrical components through an opening in the rotating shaft.

In the exemplary embodiment, the interconnecting means includes anchor means fixed within the hollow rotating shaft in proximity to the opening. It also includes terminal means associated with each of the electrical components in spaced relation thereto together with conductive sleeve means extending through the rotating shaft opening in electrically isolated relation thereto. In addition, the interconnecting means includes means accessible externally of the rotating shaft for releasably securing the terminal means and the sleeve means to the anchor means.

With this arrangement, the releasable securing means is preferably an externally threaded fastener adapted to cooperate with an internally threaded opening of an insert in the anchor means.

More specifically, the externally threaded fastener is preferably a metal screw extending through the rotating shaft opening into a metal insert to cooperate with the internally threaded opening thereof. The metal screw also extends through the terminal means likewise formed of metal and associated with each of the electrical components with the terminal means having respective openings therein adapted to receive the screw on opposite sides of the rotating shaft opening. Moreover, the metal screw not only extends through the respective terminal means but also through the conductive sleeve means thereby securing the respective terminal means in electrical contact therewith.

With this construction, the conductive sleeve means is preferably a metal bushing extending through the opening in the rotating shaft in spaced relation to the rotating shaft so as to be in electrically isolated relation thereto. In the preferred embodiment, an insulating sleeve extends completely about the metal bushing to maintain the metal bushing in electrically isolated relation to the rotating shaft.

Other objects and advantages will become apparent from the following specifiation taken in connection with the accompanying drawings.

DESCRIPTION OF THE PREFERRED EMBODIMENT

Figure 1:
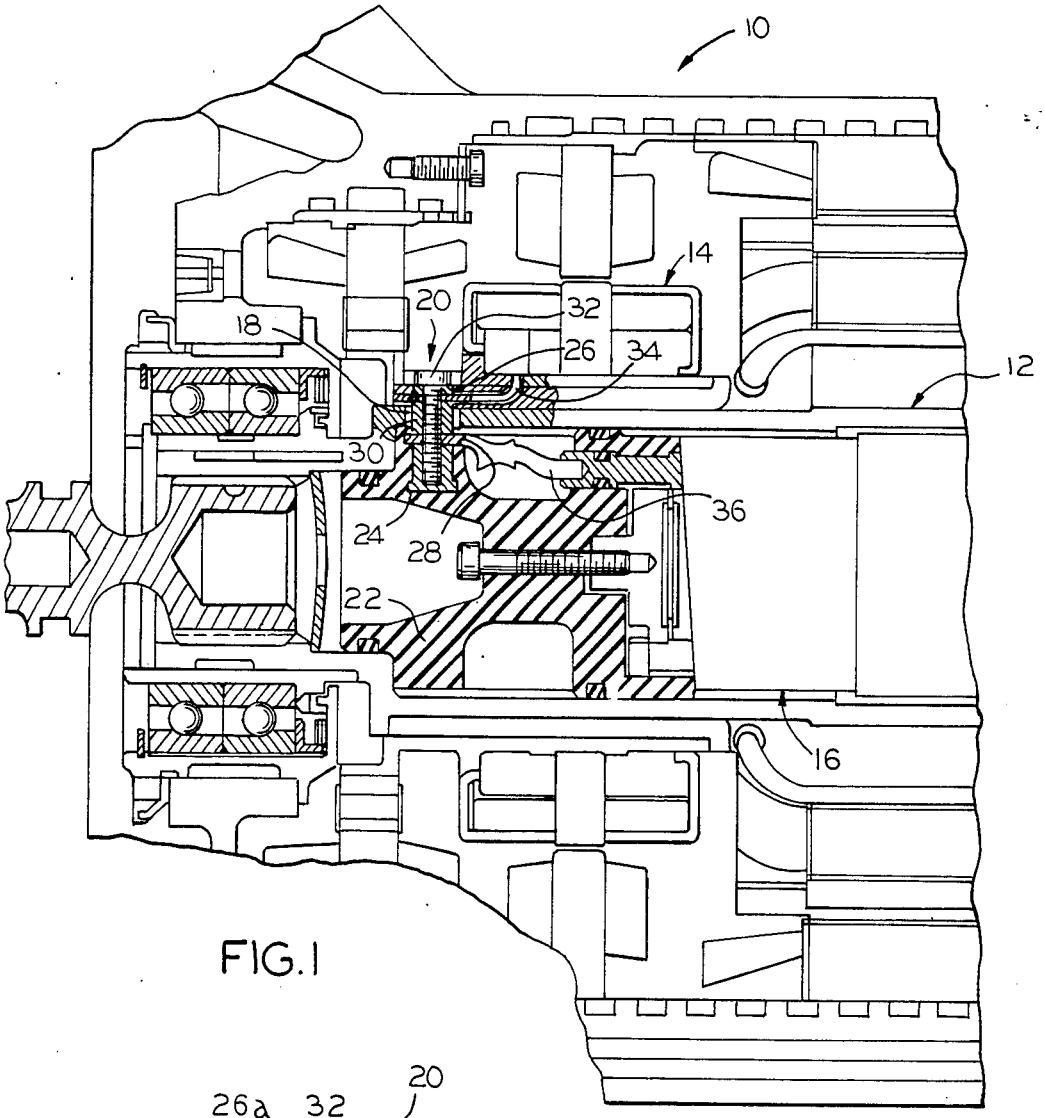
FIG. 1 is a cross sectional view of an electrical apparatus utilizing a rotating shaft electrical connection in accordance with the invention.

An exemplary embodiment of a rotating shaft electrical connection in accordance with the invention is illustrated in FIG. 1. It is there illustrated in connection with an electrical apparatus 10 having a hollow rotating shaft 12 and an electrical component 14 disposed externally of the rotating shaft 12 so as to rotate therewith together with an electrical component 16 disposed internally of the rotating shaft 12 so as to rotate therewith. With this arrangement, the externally disposed electrical component 14 is adapted to be electrically interconnected through an opening 18 in the rotating shaft 12 to the internally disposed electrical component 16.

Figure 2:
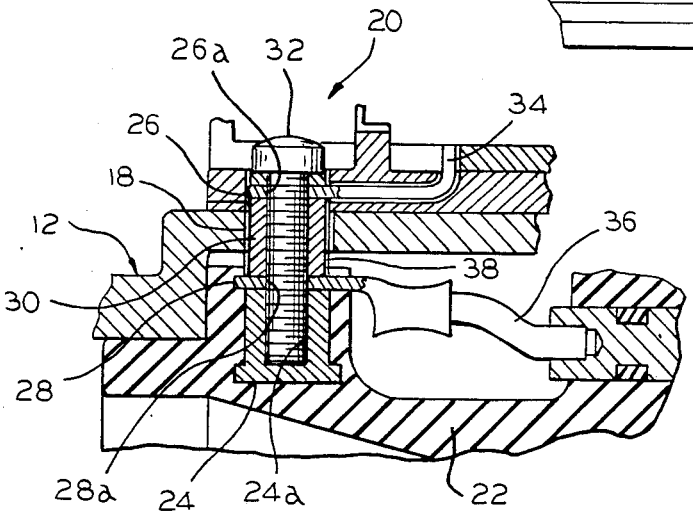
FIG. 2 is an enlarged detailed view of the rotating shaft electrical connection.

With the arrangement illustrated in FIGS. 1 and 2, the electrical apparatus 10 includes means for electrically interconnecting the electrical components 14 and 16 through the opening 18 in the rotating shaft 12 in the form of a connector assembly 20. The connector assembly 20 includes anchor means in the form of an insulator 22 having an insert 24 disposed therein with the insulator 22 and insert 24 being fixed within the hollow rotating shaft 12 in proximity to the opening 18. It also includes terminal means in the form of electrical terminals or contacts 26 and 28 associated with each of the electrical components 14 and 16, respectively, in spaced relation thereto. The connector assembly 20 further includes conductive sleeve means in the form of a bushing 30 extending through the opening 18 in the rotating shaft 12 in electrically isolated relation thereto. Additionally, the connector assembly 20 includes means such as an externally threaded fastener 32 for releasably securing the electrical terminals 26 and 28 and the bushing 30 to the insert 24 in the insulator 22.

Referring specifically to FIG. 2, the insert 24 is disposed within the insulator 22 in alignment with the opening 18 in the rotating shaft 12. In the preferred embodiment, the insert 24 is formed of metal and has an internally threaded opening 24*a*. With this arrangement, the internally threaded opening 24*a* is adapted to receive the externally threaded fastener 32 through the opening 18 in the rotating shaft 12, as shown.

Also, as shown, each of the electrical terminals 26 and 28 has an opening 26*a* and 28*a*, respectively, therein. The electrical terminals 26 and 28 are thus adapted to receive the externally threaded fastener 32 and, since one of the electrical terminals 26 is associated with the electrical component 14 disposed externally of the rotating shaft 12 and the other of the electrical terminals 28 is associated with the other of the electrical components 16 disposed internally of the rotating shaft 12, the externally threaded fastener 32 passes through the respective openings 26*a* and 28*a* of the electrical terminals 26 and 28 on opposite sides of the opening 18 in the rotating shaft 12, i.e., internally and externally of the rotating shaft 12, respectively. Referring once again to FIG. 1, the electrical terminals 26 and 28 are joined to respective ones of a pair of lead wires 34 and 36 extending from each of the electrical components 14 and 16 to a point adjacent the opening 18 in the rotating shaft 12.

As will be appreciated, the bushing 30 defining the conductive sleeve means is preferably formed of metal and extends through the opening 18 in the rotating shaft 12. It will also be appreciated that the metal bushing 30 is spaced from the rotating shaft 12 so as to be in electrically isolated relation thereto. In the preferred embodiment, an insulating sleeve 38 extends completely about the metal bushing 30 to ensure that the bushing is maintained in electrically isolated relation to the rotating shaft 12.

As previously mentioned, the releasable securing means is in the form of an externally threaded fastener 32 that extends through the opening 18 in the rotating shaft 12 and is accessible externally of the shaft for electrically interconnecting the electrical components 14 and 16. Preferably, the externally threaded fastener 32 is a metal screw adapted to extend through the openings 26*a* and 28*a* in the electrical terminals 26 and 28, through the metal bushing 30, and into the internally threaded opening 24*a* in the metal insert 24 disposed within the insulator 22.

In the preferred embodiment, the electrical terminals 26 and 28 are formed of silver plated copper and the metal bushing 30 is formed of copper to ensure high conductivity between the electrical components 14 and 16. This will facilitate the flow of current from the electrical component 16, through the lead wire 36, through the electrical terminal 28, through the metal bushing 30, through the electrical terminal 26, through the lead wire 34, and to the electrical component 14. Moreover, the metal screw 32 is preferably formed of steel, the insulator 22 is formed of a high temperature plastic insulating material adapted to be molded in a fixed position within the rotating shaft 12 or threaded into position therein, and the metal insert 24 is preferably formed of steel.

With the connector assembly 20 of the invention, there is no requirement for the metal screw 32, the threads between the metal screw 32 and the metal insert 24, or the metal insert 24 to carry current. This makes it possible to form the metal screw 32 and the metal insert 24 of steel rather than a soft metal of high conductivity such as copper or a copper alloy to ensure a secure connection capable of withstanding high centrifugal forces as well as other severe environmental conditions and thereby avoiding parts that may shrink and loosen in the area where the various connecting components are electrically interconnected. As a result, only the electrical terminals 26 and 28 and the bushing 30 need be formed of soft metals characterized by low resistance and high conductivity.

As will be appreciated, the connector assembly 20 is particularly well suited for use with an electrical apparatus 10 such as a high frequency generator of the type utilized in aircraft. In such a generator, there will actually be a plurality of connector assemblies 20 circumferentially spaced about the rotating shaft 12 and utilized to conduct current between electrical components 14 and/or 16 and/or other electrical components in the form of an exciter, rotating rectifiers, and the main field of the generator. Because the connector assemblies 20 are readily accessible externally of the rotating shaft 12, disassembly of the electrical connection is easily accomplished to replace damaged electrical components.

As will be appreciated, the connector assembly 20 renders it impossible for the rotating shaft 12 to cut through the lead wires 34 and 36 since they do not pass through the opening 18. It will also be appreciated that the connector assembly 20 provides a secure connection with good metal-to-metal contact by components of low resistance and high conductivity. This is accomplished since the metal screw, threads, and metal insert need not carry current, and it is achieved with a connector assembly 20 which can easily be assembled and disassembled by using simple tools in contrast to brazed joints which render it difficult, if not impossible, to replace defective electrical components. It will further be appreciated that the connector assembly 20 is particularly well suited for high frequency generators having variable speed shafts operable up to and beyond 30,000 R.P.M. and temperatures on the order of 300 to 350° F. Moreover, if desired, the metal screws 32 can be wrapped with fiberglass/epoxy to further ensure maintaining the electrical terminals or contacts 26 and 28 and the bushing 30 in good electrical contact.

While in the foregoing there has been set forth a preferred embodiment of the invention, it is to be understood that the invention is only to be limited by the spirit and scope of the appended claims.

We claim:

1. In an electrical apparatus having a hollow rotating shaft, said electrical apparatus having an electrical component disposed externally of said rotating shaft and adapted to rotate therewith and said electrical apparatus having an electrical component disposed internally of said rotating shaft and adapted to rotate therewith, said externally disposed electrical component adapted to be electrically interconnected through an opening in said rotating shaft to said internally disposed electrical component, the improvement comprising:

means for electrically interconnecting said electrical components through said rotating shaft opening, said interconnecting means including an insulator fixed within said hollow rotating shaft in proximity to said rotating shaft opening and an insert disposed within said insulator in alignment with said rotating shaft opening, terminal means of low resistance and high conductivity associated with each of said electrical components in spaced relation thereto and having an opening adapted to receive a fastener on opposite sides of said rotating shaft opening, conductive sleeve means of low resistance and high conductivity extending through said rotating shaft opening and spaced from said rotating shaft so as to be in electrically isolated relation thereto, and a fastener extending through said rotating shaft opening and operatively associated with said insert for electrically interconnecting said electrical components through said terminal means and said conductive sleeve means.

2. The electrical apparatus as defined by claim 1 wherein said insert is formed of metal and has an internally threaded opening, said internally threaded opening being adapted to receive said fastener through said rotating shaft opening.

3. The electrical apparatus as defined by claim 2 including a lead wire extending from each of said electrical components to said rotating shaft opening, each of said terminal means being formed of metal and being joined to one of said lead wires adjacent said rotating shaft opening.

4. The electrical apparatus as defined by claim 3 wherein said conductive sleeve means comprises a bushing formed of metal and including an insulating sleeve extending completely about said metal bushing, said insulating sleeve maintaining said metal bushing in electrically isolated relation to said rotating shaft.

5. The electrical apparatus as defined by claim 4 wherein said fastener is externally threaded and extends through said rotating shaft opening, said externally threaded fastener being accessible externally of said rotating shaft for electrically interconnecting said electrical components.

6. The electrical apparatus as defined by claim 5 wherein said externally threaded fastener is a metal screw adapted to extend through said terminal means and said metal bushing into said metal insert in said insulator.

* * * * *